US008166981B2

(12) United States Patent
Ammann

(10) Patent No.: US 8,166,981 B2
(45) Date of Patent: May 1, 2012

(54) HAIR STYLING TOOL

(76) Inventor: Kathryn Ammann, Downey, CA (US)

( * ) Notice: Subject to any disclaimer, the term of this patent is extended or adjusted under 35 U.S.C. 154(b) by 86 days.

(21) Appl. No.: 12/755,636

(22) Filed: Apr. 7, 2010

(65) Prior Publication Data

US 2011/0232672 A1 Sep. 29, 2011

Related U.S. Application Data

(63) Continuation-in-part of application No. 29/349,319, filed on Mar. 24, 2010, now Pat. No. Des. 631,194.

(51) Int. Cl.
*A45D 2/00* (2006.01)
*A45D 7/02* (2006.01)
*A45D 8/40* (2006.01)

(52) U.S. Cl. ..... 132/223; 132/212; 132/274

(58) Field of Classification Search ..... 132/271, 132/212, 270, 272, 273, 223, 274, 227, 228, 132/333, 902, 229, 210, 211, 243, 233, 237, 132/238, 213, 54; D28/7, 9, 10, 35, 12, 13, D28/39; 99/495, 501, 503, 508, 513; D7/667; 34/96–101; 210/464, 470, 465; 220/370, 220/371, 372, 376; 222/480, 548, 565, 189.02, 222/189.03; 209/371, 397, 274, 362
See application file for complete search history.

(56) References Cited

U.S. PATENT DOCUMENTS 2,416,788 A * 3/1947 Andrews ..... 34/99
2,781,764 A * 2/1957 Miller ..... 132/212
3,113,848 A * 12/1963 Clark, Jr. ..... 34/99
3,418,726 A * 12/1968 Sparks ..... 34/99
3,692,066 A * 9/1972 Fava ..... 132/212
3,800,431 A * 4/1974 Hubner ..... 34/99
3,908,673 A * 9/1975 Carr ..... 132/223
3,911,934 A * 10/1975 Helbling ..... 132/271
4,008,726 A * 2/1977 DiGiuseppe ..... 132/136
4,391,047 A * 7/1983 Janssens et al. ..... 34/97
4,433,492 A * 2/1984 Santa Lucia ..... 34/99
4,724,852 A * 2/1988 Ramik ..... 132/270
4,987,618 A * 1/1991 Tolbert ..... 4/515
5,303,483 A * 4/1994 Chan ..... 34/97
5,392,528 A * 2/1995 McDougall ..... 34/97
5,515,874 A * 5/1996 Denebeim ..... 132/226
D383,245 S * 9/1997 Seifert ..... D28/35
D384,772 S * 10/1997 Kling ..... D28/18
D393,925 S * 4/1998 Kling ..... D28/18
D486,264 S * 2/2004 Enriquez ..... D28/13
6,922,909 B2 * 8/2005 Andrew et al. ..... 34/96
D544,998 S * 6/2007 Petruccelli ..... D28/13
(Continued)

*Primary Examiner* — Todd Manahan
*Assistant Examiner* — Vanitha Elgart
(74) *Attorney, Agent, or Firm* — Clement Cheng

(57) ABSTRACT

A hairstyling tool has a bowl having a plurality of bowl convex portions and bowl concave portions. The bowl concave portions form air channels. A plurality of openings is disposed on a bottom of the bowl. There are more than twenty openings. A handle is connected to the bowl. The handle has a handle connection with the bowl. A base extends from the bottom of the bowl. The base extends downward around the plurality of openings disposed on the bottom of the bowl. The base forms an air capture indent for directing airflow through the plurality of openings. The handle concave portions and handle convex portions may provide the handle a wavy shape. The handle may extend from a bowl convex portion between a pair of air channels. A palm rest can be at a free end of the handle.

15 Claims, 9 Drawing Sheets

U.S. PATENT DOCUMENTS

| | | | | |
|---|---|---|---|---|
| D558,536 | S * | 1/2008 | Curtin | D7/667 |
| 7,464,638 | B2 * | 12/2008 | Tremblay | 99/323 |
| D624,351 | S * | 9/2010 | Stewart et al. | D7/354 |
| D631,194 | S * | 1/2011 | Ammann | D28/10 |
| 2003/0159306 | A1 * | 8/2003 | Yeung | 34/96 |
| 2004/0112821 | A1 * | 6/2004 | Hutzler | 210/238 |
| 2007/0295227 | A1 * | 12/2007 | Raineri | 99/484 |
| 2008/0271337 | A1 * | 11/2008 | Chan | 34/98 |
| 2010/0088857 | A1 * | 4/2010 | Blauer et al. | 16/430 |

* cited by examiner

HAIR STYLING TOOL

This application is a continuation in part of and claims priority from inventor Kathryn Ammann's U.S. design patent application Ser. No. 29/349,319 for hair styling tool filed Mar. 24, 2010 now U.S. Pat. No. D,631,194, the entire disclosure of which is incorporated herein by reference.

BACKGROUND OF THE INVENTION

A. Field of the Invention

The present invention relates to a hair styling tool.

B. Discussion of Related Art

A variety of hair styling tools has been used for performing a variety of different operations with hair. A portable hairstyle implement can be exemplified by the tool shown in U.S. Pat. No. 4,976,276 issued to Avery on Dec. 11, 1990, the disclosure of which is incorporated herein by reference. The Avery portable hairstyle tool has a styling bowl with conical projections for focusing a stream of heated air from the drying unit onto a user. The styling cones aim for providing a type of style to the hair. Unfortunately, for longer more curly hair the Avery portable hairstyle tool might not be as effective for scrunching, especially if there were insufficient diffusing of airflow though the cones that direct heated air to the hair mass.

SUMMARY OF THE INVENTION

Embodiments of the invention will now be described by way of example with reference to the accompanying drawings. The present invention works as a scrunching tool which relies upon the curling of the hair inside the bowl, which is hat shaped having a substantial depth compared to the Avery device. As a rule of thumb, the bowl would have a substantial depth, enough to hold a mass of hair in a curled configuration.

A hairstyling tool has a bowl having a plurality of bowl convex portions and bowl concave portions. The bowl concave portions form air channels. A plurality of openings is disposed on a bottom of the bowl. There are more than twenty openings. A handle is connected to the bowl. The handle has a handle connection with the bowl. A base extends from the bottom of the bowl. The base extends downward around the plurality of openings disposed on the bottom of the bowl. The base forms an air capture indent for directing airflow through the plurality of openings. The handle concave portions and handle convex portions may provide the handle a wavy shape. The handle may extend from a bowl convex portion between a pair of air channels. A palm rest can be at a free end of the handle. A strap can be connected to the handle at a strap opening formed on the handle. The handle can be formed with a channel on its underside. The base further may have a plurality of base convex portions, and a plurality of base concave portions, so that the air channels begin at the base and terminate at a rim of the bowl.

Figure 1:
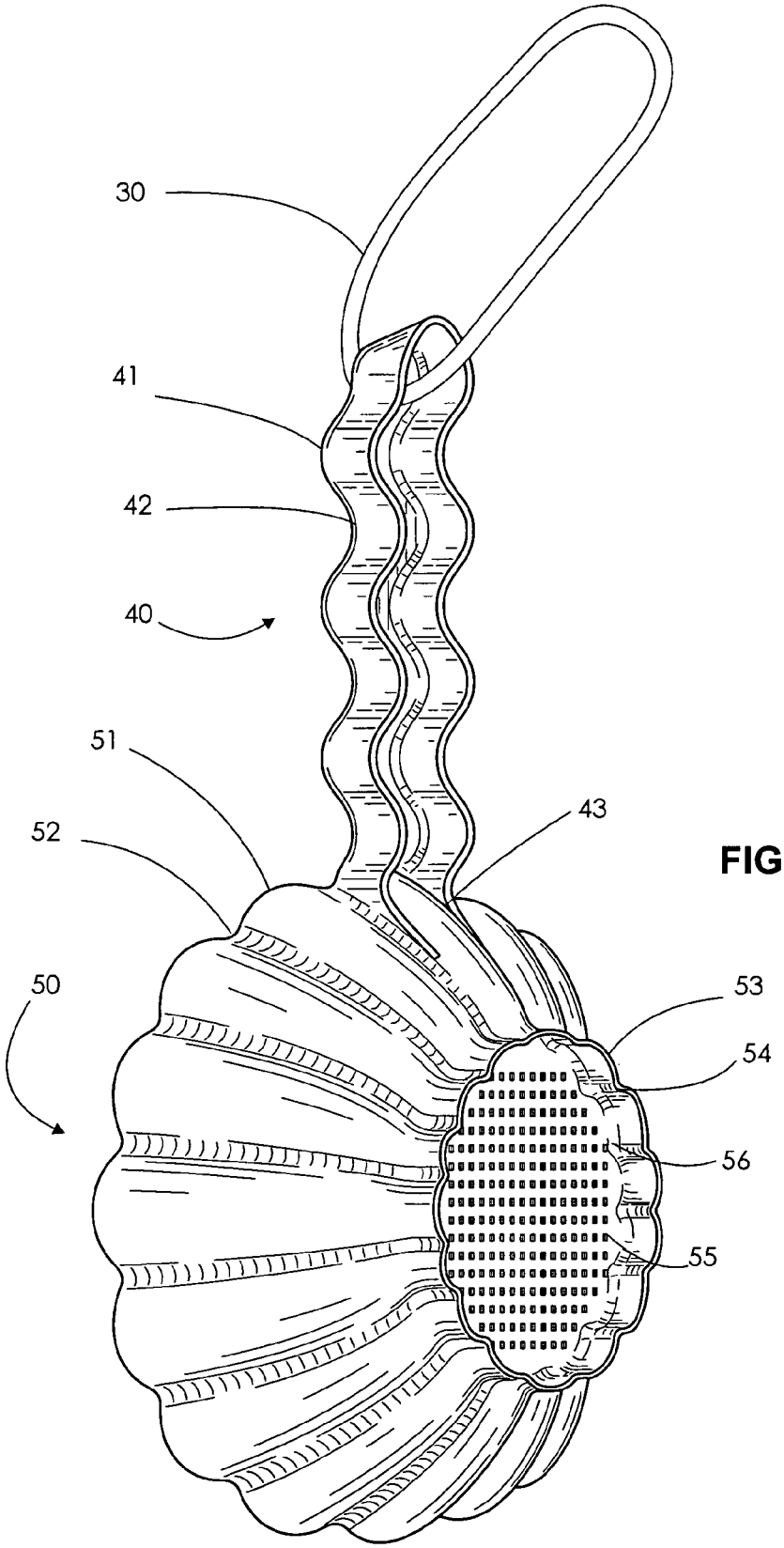
FIG. 1 is a perspective view of a hair styling tool.
Figure 2:
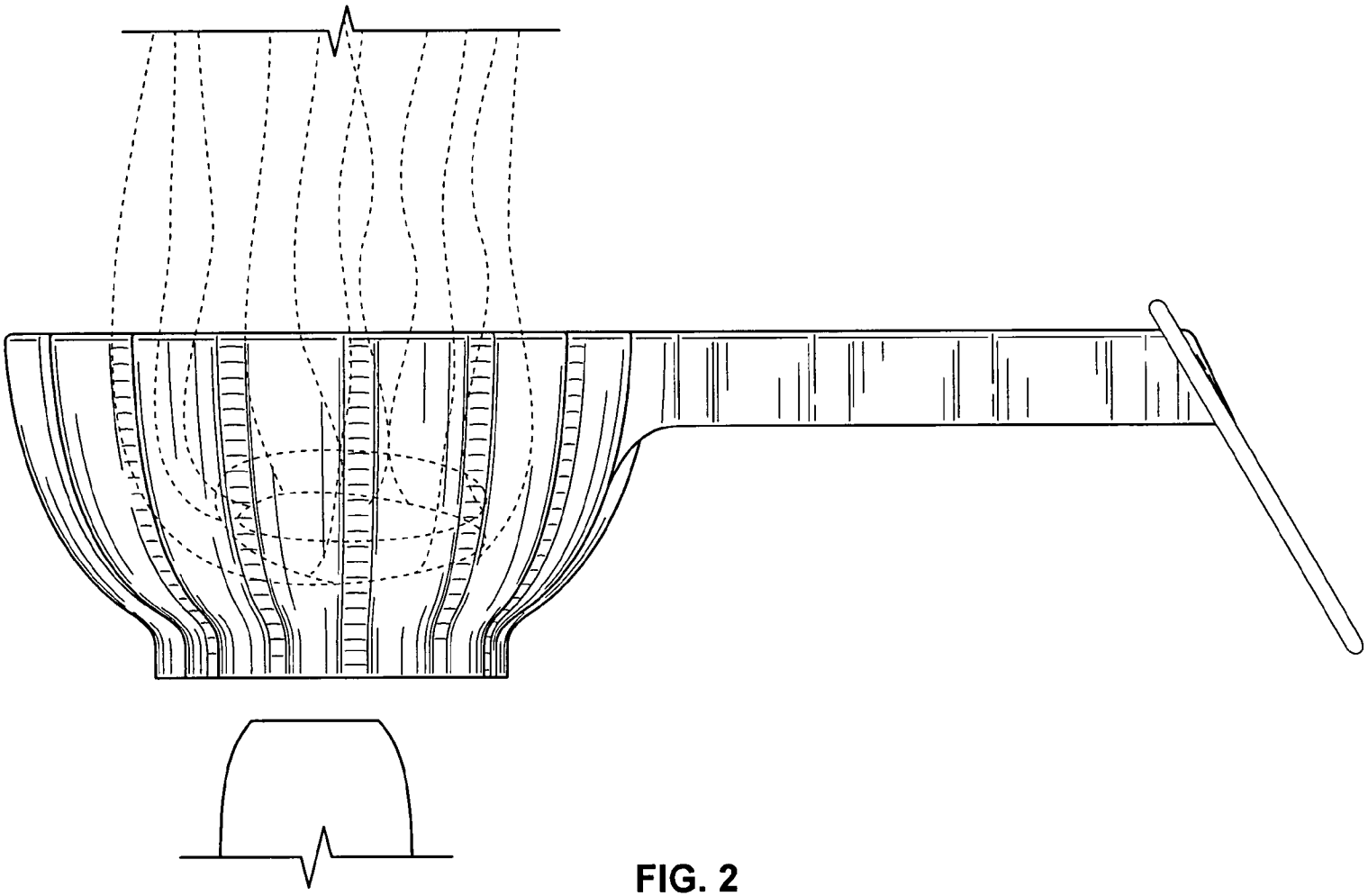
FIG. 2 is a front view showing the tool in use.
Figure 3:
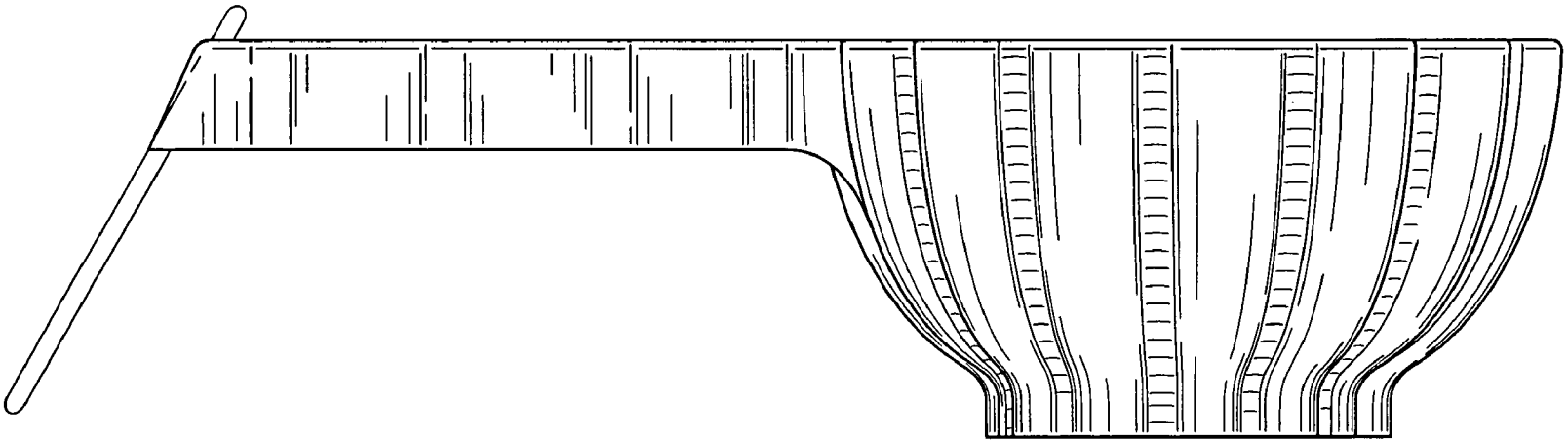
FIG. 3 is a rear view.
Figure 4:
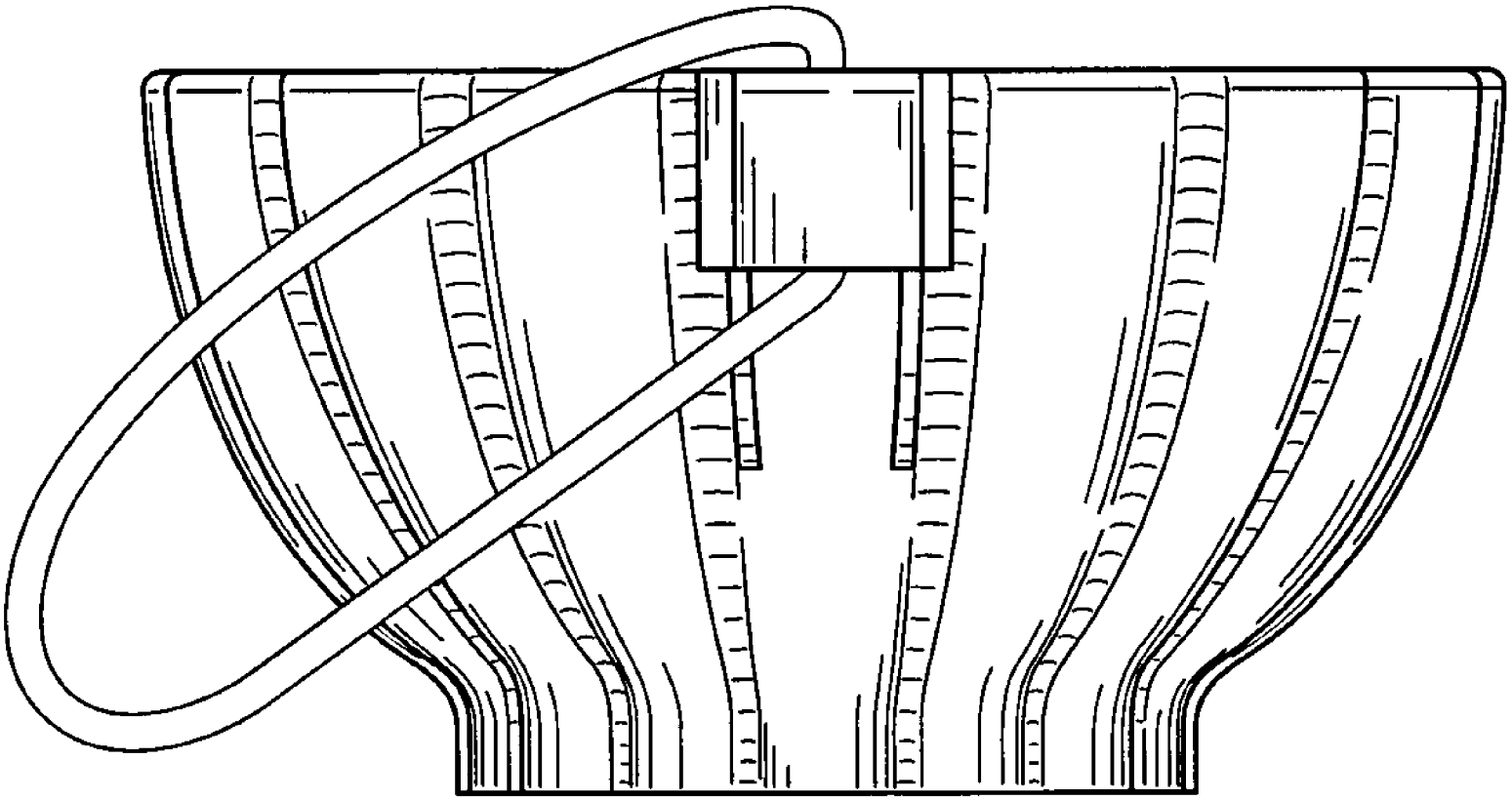
FIG. 4 is a left side view.
Figure 5:
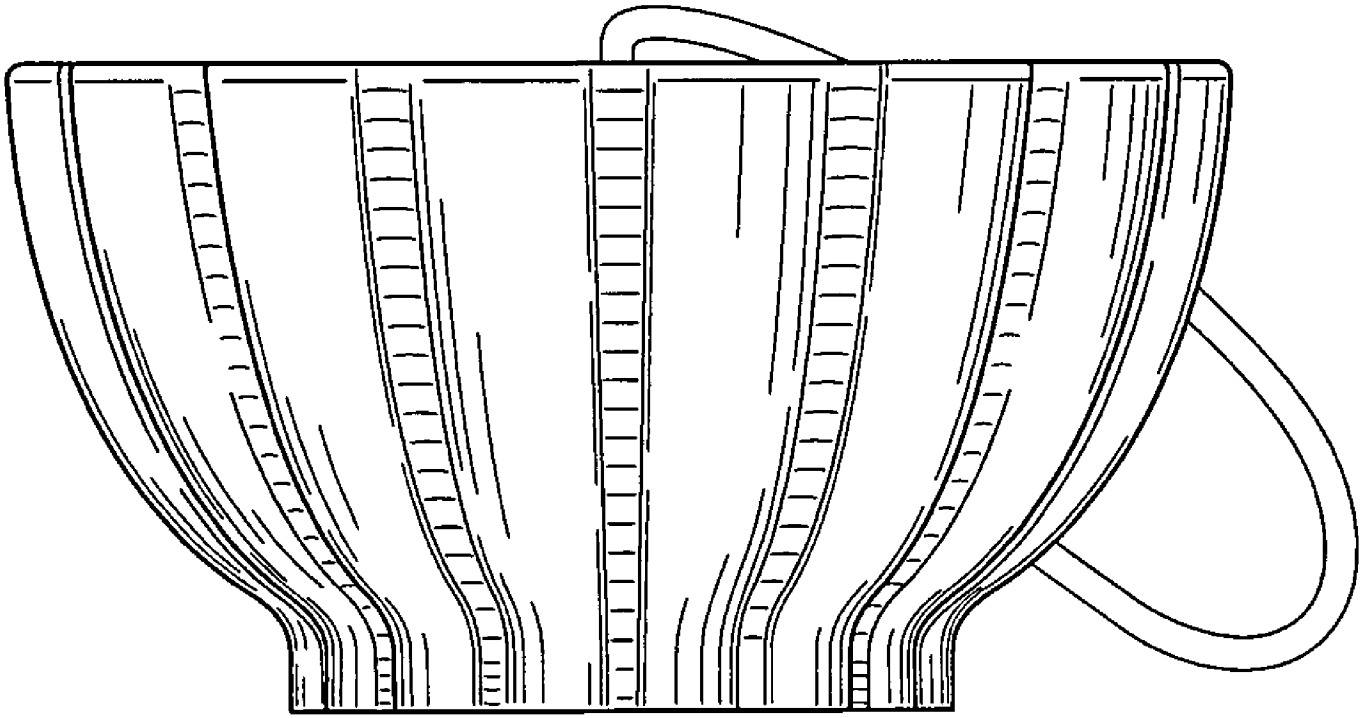
FIG. 5 is a right side view.
Figure 6:
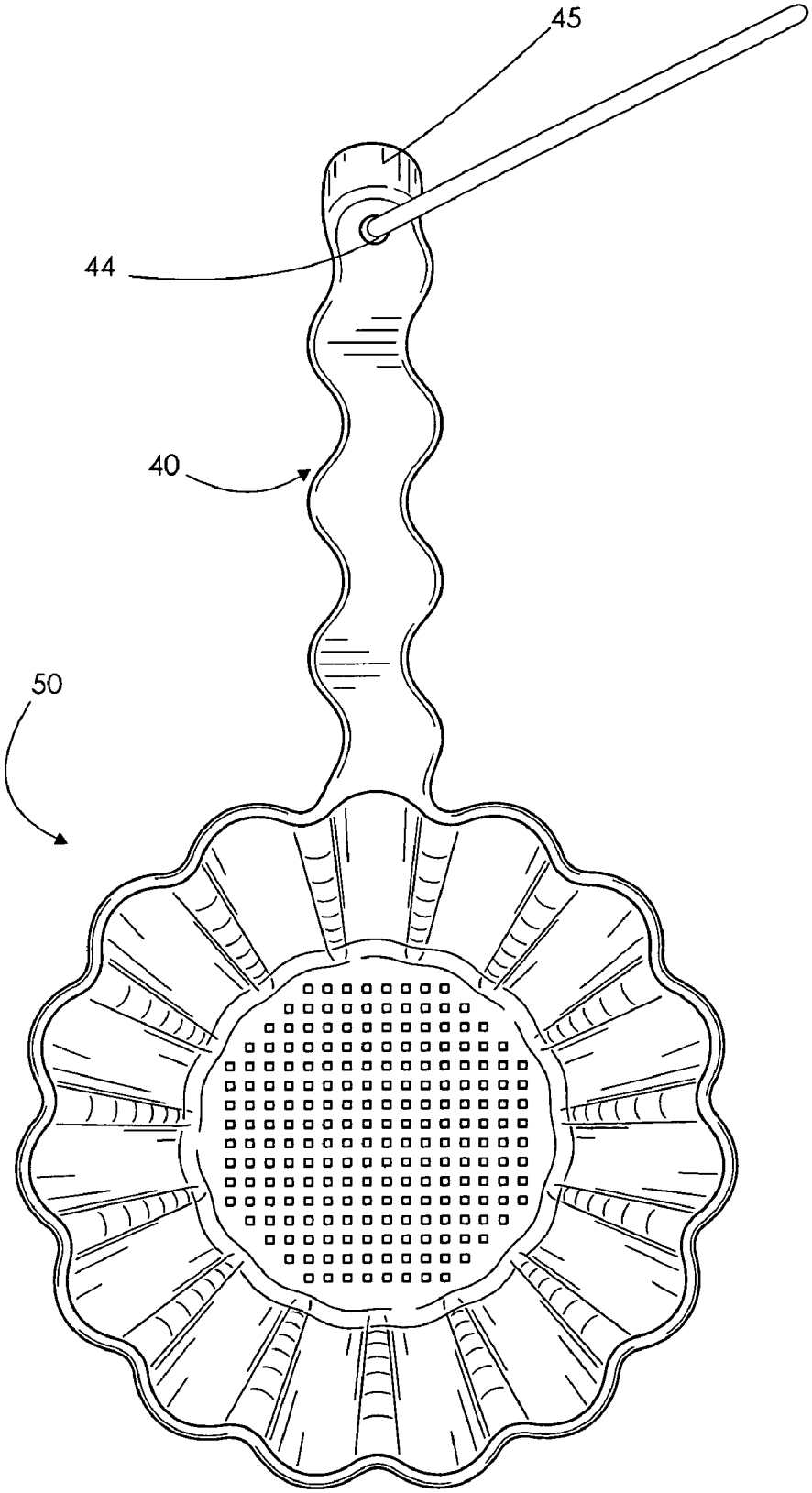
FIG. 6 is a top view.
Figure 7:
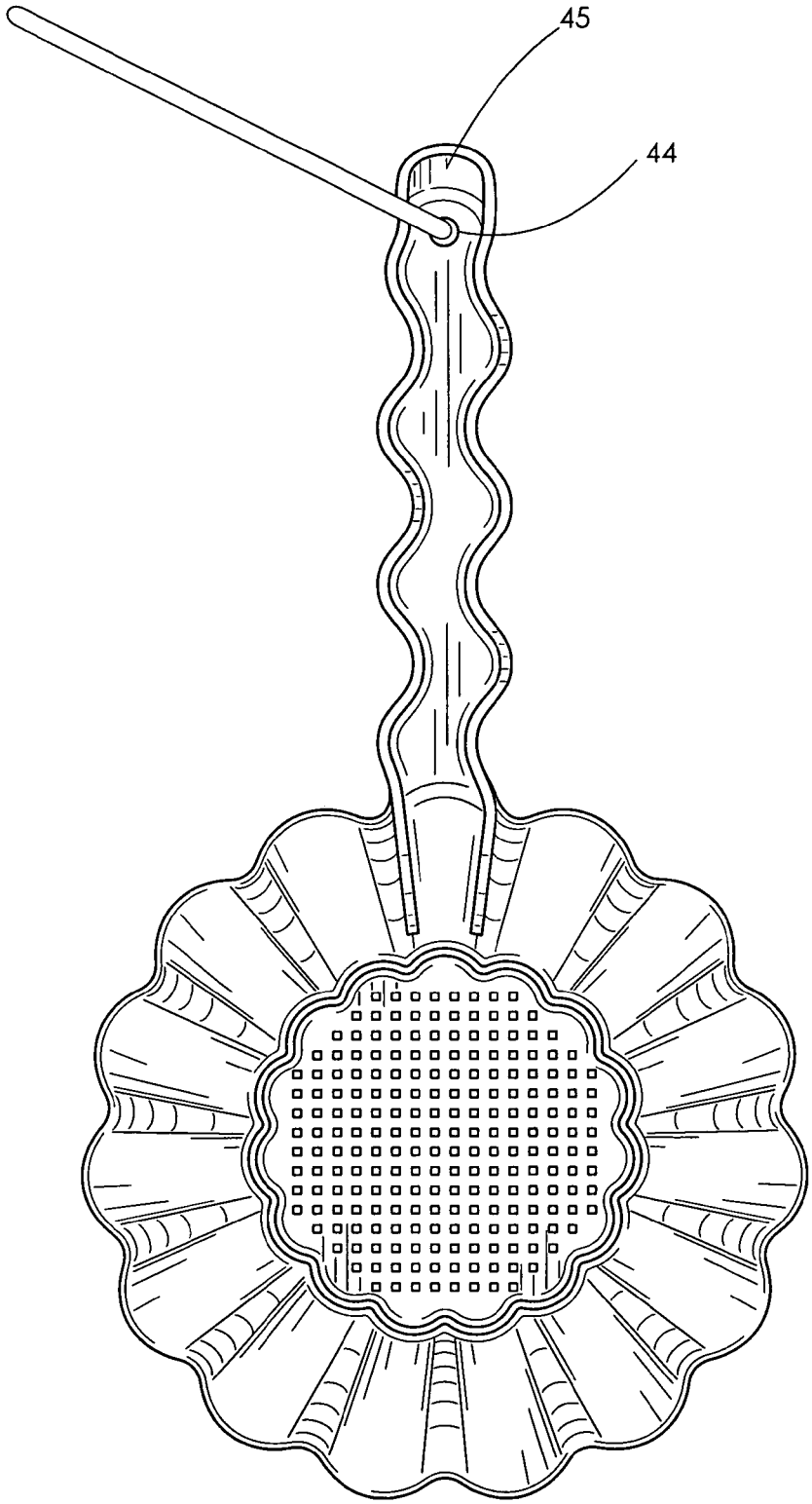
FIG. 7 is a bottom view.

The following call out list of elements can be used for referencing the drawings:

30 Strap
40 Handle
41 Handle Convex
42 Handle Concave
43 Handle Connection
44 Strap Opening
45 Palm Rest
50 Bowl
51 Bowl Convex
52 Bowl Concave
53 Base Convex
54 Base Concave
55 Openings
56 Base Connection
81 Angled Base Connection
82 Angled Bowl Concave
83 Angled Handle Profile

DETAILED DESCRIPTION OF THE PREFERRED EMBODIMENT

With reference to the figures, the strap 30 is connected to the handle 40 at a strap opening 44 located on the handle. The strap preferably fits around a wrist of a user, somewhat loosely to allow the user to bounce the tool up and down for scrunching hair. The handle is preferably of a wave shape to allow improved grip and control. The handle preferably has a plurality of handle convex portions 41 and a plurality of handle concave portions 42 in between the handle convex portions. Preferably, there are about three handle concave portions and three handle convex portions. A handle connection 43 connects the handle to the bowl 50 and the handle connection preferably tapers down to blend with a complementary structure on the bowl. The handle is a proximate as long as the diameter of the bowl.

Figure 8:
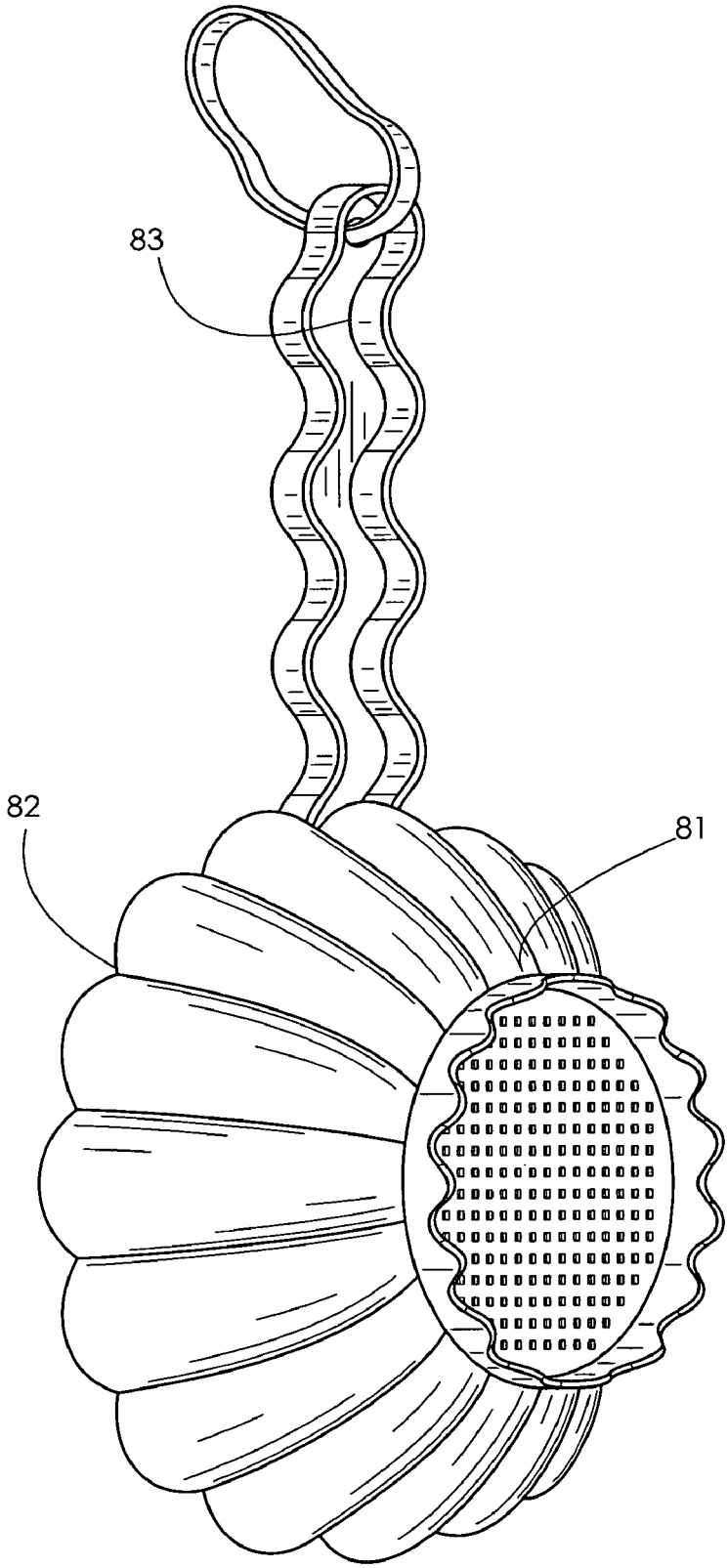
FIG. 8 is a perspective view of an alternate construction.
Figure 9:
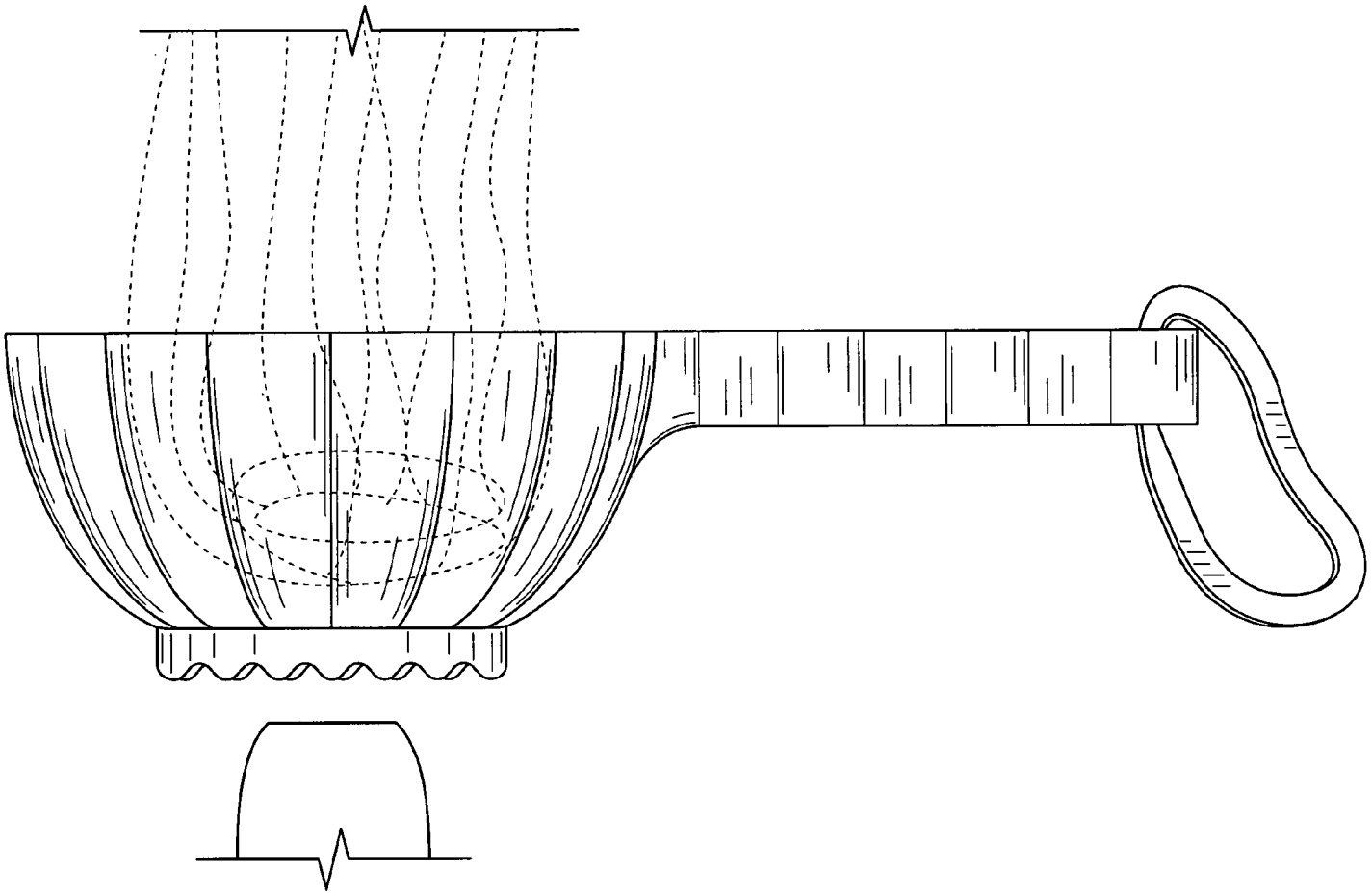
FIG. 9 is a front view of an alternate construction showing the tool in use.

The handle is preferably substantially hollow and forming a channel on the bottom side, such that the channel is a slot shaped profile having preferably equal thickness plastic throughout the length of the handle. Although the internal surface of the channel is rounded in the preferred embodiment, the channel can also have an angled handle profile 83 formed on the inside of the handle, as seen in FIG. 8. The channel preferably opens downward. When the handle is substantially hollow, the handle should have a top wall, and a pair of sidewalls but no bottom wall.

A plurality of bowl concave portions 52 are placed between a plurality of bowl convex portions 51 that extend from the bowl concave portions 52. The bowl concave portions 51 are formed as radially extending channels between the plurality of bowl convex portions. The radially extending channels preferably have an internal radius of curvature less than the radius of curvature of the bowl concave portions. In an alternate embodiment shown on FIG. 8, the bowl concave portions are formed as an angled bowl concave 82.

The base also preferably includes a base convex portions 53 alternating with base concave portions 54. The base convex portions 53 preferably align with the bowl convex portions 51 while the base concave portions 54 preferably align with the bowl concave portions 52. The channels for receiving air on an outside surface of the bowl begin at the base concave portions 54 and then extend and continue to the bowl concave portions 52. The channels for receiving air are used when a user uses an edge of the bowl for capturing air and directing the air to a portion of hair. The base additionally forms an air capture indent that has a plurality of openings 55. The plurality of openings can be arranged in a grid as shown in the drawings, or can be arranged in a random or fanciful pattern. The plurality of openings directs airflow through the bottom of the bowl so that when the hairdryer is pointed to the air capture indent, the plurality of openings diffuses the airflow through the plurality of openings 55, but at the same time the channels formed on the exterior portion of the bowl provides deflection of air.

The number of bowl concave portions and bowl convex portions are preferably approximately fifteen in number, but can be as little as five or as many as twenty. The number of openings shown in the figures is two hundred sixteen. The preferred number of openings is more than 20, but less than 500. It is preferred to have more than a hundred openings. The openings are preferably less than a half inch in diameter. The palm rest 45 of the handle is preferably at a 60° angle as shown in the drawings and mounted at the free end of the handle opposite to the connection end of the handle.

The base of the bowl is optionally of an angled configuration as seen in FIG. 8. The connection between the base and the bowl is optionally an angled base connection 81. The base of the bowl is also optionally wavy and not flat such that when it rests on a flat surface such as a table, the base has less surface area contacting the table.

The present invention provides a pair of modes for operating the device and in both modes, a user can use the tool to move the hair around while drying the hair. The user uses the bowl in a first mode for holding up long hair in curled configuration while directing air at the bottom of the air capture indent. The larger number of smaller openings provides a diffusion tool to allow the air to dry the long hair in a scrunched style. The user in a second mode uses the bowl for directing air over the rim of the bowl along air channels for directing air into a mass of hair without diffusion so that the air channels penetrate into the mass of hair.

The foregoing describes the preferred embodiments of the invention. Modifications may be made without departing from the spirit and scope of the invention as set forth in the following claims. The present invention is not limited to the embodiments described above, but encompasses any and all embodiments within the scope of the following claims. Therefore, while the presently preferred form of the hair styling tool has been shown and described, and several modifications thereof discussed, persons skilled in this art will readily appreciate that various additional changes and modifications may be made without departing from the spirit of the invention, as defined and differentiated by the following claims.

The invention claimed is:

1. A hairstyling tool comprising:

a. a bowl having a plurality of bowl convex portions and bowl concave portions, wherein the bowl concave portions form air channels, wherein the plurality of bowl concave portions are placed between bowl convex portions that extend from the bowl concave portions, wherein the bowl concave portions are formed as radially extending channels between the plurality of bowl convex portions, wherein the radially extending channels have an internal radius of curvature less than a radius of curvature of the bowl concave portions;

b. a plurality of openings disposed on a bottom of the bowl, wherein there are more than twenty openings and the openings are less than a half inch in diameter;

c. a handle connected to the bowl, wherein the handle has a handle connection with the bowl, wherein the handle is formed with a handle channel on an underside of the handle, wherein the handle is substantially hollow; and d. a base extending from the bottom of the bowl, wherein the base extends downward around the plurality of openings disposed on the bottom of the bowl, wherein the base forms an air capture indent for directing airflow through the plurality of openings.

2. The hairstyling tool of claim 1, wherein the handle further comprises handle concave portions and handle convex portions, wherein the handle has a wavy shape.

3. The hairstyling tool of claim 1, wherein the handle extends from a bowl convex portion, between a pair of air channels.

4. The hairstyling tool of claim 1, wherein the handle further includes a palm rest at a free end of the handle.

5. The hairstyling tool of claim 1, further comprising a strap connected to the handle at a strap opening formed on the handle.

6. The hairstyling tool of claim 1, wherein the base further includes a plurality of base convex portions, and a plurality of base concave portions, wherein the air channels begin at the base, and terminate at a rim of the bowl.

7. The hairstyling tool of claim 6, wherein the handle further comprises handle concave portions and handle convex portions, wherein the handle has a wavy shape.

8. The hairstyling tool of claim 6, wherein the handle extends from a bowl convex portion, between a pair of air channels.

9. The hairstyling tool of claim 6, wherein the handle further includes a palm rest at a free end of the handle.

10. The hairstyling tool of claim 6, further comprising a strap connected to the handle at a strap opening formed on the handle.

11. The hairstyling tool of claim 6, wherein the base further includes a plurality of base convex portions, and a plurality of base concave portions, wherein the air channels begin at the base, and terminate at a rim of the bowl, wherein there are more than a hundred openings at the bottom of the bowl.

12. The hairstyling tool of claim 11, wherein the handle further comprises handle concave portions and handle convex portions, wherein the handle has a wavy shape.

13. The hairstyling tool of claim 11, wherein the handle extends from a bowl convex portion, between a pair of air channels.

14. The hairstyling tool of claim 11, wherein the handle further includes a palm rest at a free end of the handle.

15. The hairstyling tool of claim 11, further comprising a strap connected to the handle at a strap opening formed on the handle.

* * * * *